US008057160B2

(12) United States Patent
Bart et al.

(10) Patent No.: US 8,057,160 B2
(45) Date of Patent: Nov. 15, 2011

(54) DEVICE FOR LIMITING TURBINE OVERSPEED IN A TURBOMACHINE

(75) Inventors: Jacques Rene Bart, Soisy sur Seine (FR); Didier Rene Andre Escure, Nandy (FR); Stephane Rousselin, Hericy (FR)

(73) Assignee: SNECMA, Paris (FR)

( * ) Notice: Subject to any disclaimer, the term of this patent is extended or adjusted under 35 U.S.C. 154(b) by 1033 days.

(21) Appl. No.: 11/877,037

(22) Filed: Oct. 23, 2007

(65) Prior Publication Data

US 2008/0101917 A1 May 1, 2008

(30) Foreign Application Priority Data

Oct. 30, 2006 (FR) ..... 06 09502

(51) Int. Cl.
*F01D 21/02* (2006.01)
*F01D 21/00* (2006.01)

(52) U.S. Cl. ..... 415/9

(58) Field of Classification Search ..... 415/9, 30; 416/44

See application file for complete search history.

(56) References Cited

U.S. PATENT DOCUMENTS 3,490,748 A * 1/1970 Hoffman ..... 415/9
7,484,924 B2 * 2/2009 Soupizon ..... 415/9

FOREIGN PATENT DOCUMENTS

| | | |
|---|---|---|
| CH | 369938 | 6/1963 |
| EP | 1 640 564 A1 | 3/2006 |
| FR | 1.486.102 | 6/1967 |

* cited by examiner

*Primary Examiner* — Edward Look
*Assistant Examiner* — Dwayne J White
(74) *Attorney, Agent, or Firm* — Oblon, Spivak, McClelland, Maier & Neustadt, L.L.P.

(57) ABSTRACT

A device (40) for limiting overspeed in a turbomachine in the event of breakage of the turbine shaft (24), comprising means (38, 44) of propelling a pin (42) into the path of the blades (22), these propelling means being controlled by means (36) that detect overspeed or that the turbine shaft has broken.

12 Claims, 3 Drawing Sheets

DEVICE FOR LIMITING TURBINE OVERSPEED IN A TURBOMACHINE

BACKGROUND OF THE INVENTION

The present invention relates to a device for limiting overspeed in a turbomachine such as an aircraft jet engine, in order to guard against turbine shaft breakage, a phenomenon which is extremely rare but the consequences of which may prove disastrous.

When this shaft breaks, the turbine rotor finds itself uncoupled from the fan which was limiting its rotational speed, but the blades of the turbine continue to be turned by the gases leaving the turbomachine combustion chamber. The turbine then begins to "overspeed" or "spin", thus subjecting the rotor to excessive centrifugal forces liable to cause it to explode, with the risks of puncturing the outer casing of the turbine and also the fuselage of the aircraft equipped with this turbomachine. The overspeed limit is therefore a constraint that absolutely must be observed in turbomachines.

DESCRIPTION OF THE PRIOR ART

The known devices for limiting overspeed generally make use of the downstream displacement of the turbine rotor that results from breakage of the turbine shaft and the pressure of the gases on the rotor blades.

Devices for mechanically slowing the turbine rotor have thus already been proposed, these comprising means borne by the rotor and intended to bear against corresponding means belonging to the stator so as to slow the rotor, following its downstream displacement after the turbine shaft has broken.

It has also been proposed for the stator guide vanes to be mounted removably or pivotably so that the rotor, as a result of its downstream displacement following breakage of the turbine shaft, presses against these vanes and causes them to pivot into the path of the blades in order to destroy them and thus slow the rotation of the turbine. This known solution is, however, relatively complicated and expensive.

The known devices have the disadvantage of being relatively slow, thus detracting from their effectiveness. This is particularly penalizing in the case of small engines, in which the lower inertia of the turbine rotor leads to the risk that the onset of overspeed will occur more quickly.

Furthermore, because the devices need to have positive contact between components, they may find themselves inoperative if the rotor bounces back off a fixed component or if this rotor begins to orbit.

The slowing devices based on friction between components have an effectiveness that is difficult to predict because they call upon numerous uncertain parameters such as the temperature or the force exerted between the components.

Furthermore, some known devices have the disadvantage of increasing the overall mass of the turbine and of altering the aerodynamic profile of its components, to the detriment of engine performance.

SUMMARY OF THE INVENTION

It is one particular object of the invention to provide a simple, economic and effective solution to these problems, making it possible to avoid the disadvantages of the known art.

Another object of the invention is more satisfactorily to meet the reliability and speed of response requirements of a device for limiting turbine overspeed in a turbomachine.

To these ends, the invention proposes a device for limiting turbine overspeed in a turbomachine in the event of breakage of the turbine shaft, comprising means for shearing the blades of at least one stage of the turbine, wherein these shearing means comprise means for propelling a pin into the path of the blades, these propelling means being mounted on a casing of the turbine or of the turbomachine and controlled by means that detect that the turbine is experiencing overspeed or that the shaft of this turbine has broken.

The blades intercepted by the pin are destroyed under the effect of the collision with this pin and their fragments are propelled onto the other rotor blades and onto the stator vanes of the turbine, and destroy them. The rotor, no longer driven by the blades, can no longer destroy anything as a result of overspeed.

The essential advantage of this device is that it is not dependent on the shifting of the rotor and can be initiated without waiting for this shifting to occur, thus guaranteeing a faster response, the speed of the device now being dependent only on the response time of the propelling means. In addition, the operation of this device will not, unlike certain earlier devices, be penalized if the turbine bounces back or the rotor begins to orbit.

According to a preferred embodiment of the invention, the propelling means comprise a capsule of explosive substance housed in a cylinder suitable for guiding the pin as the capsule explodes.

Advantageously, pellets of a substance capable of generating a gas under the effect of detonation, such as sodium azide for example, are placed near the capsule of explosive substance in this cylinder.

Thus, it is the blast produced by the explosion of the capsule and, as appropriate, by the release of gas produced by the aforementioned pellets that propels the pin into the path of the blades in order to destroy them. The use of sodium azide pellets, already known in the field of automotive airbags, allows an optimum reaction speed.

As an alternative, it is possible to resort to conveying pressurized gas bled off the engine or supplied by a reserve of pressurized gas.

In a preferred embodiment of the invention, the cylinder is mounted on the outside of the casing in line with an orifice of this casing that opens onto the path of the blades, and comprises an open end via which it is attached to the casing, its other end being closed and containing the capsule of explosive substance.

The pin extends entirely inside the cylinder when it is in the rest condition, before the onset of overspeed has been detected or before breakage of the low-pressure turbine shaft has been detected, and it has a cylindrical body, one end of which is guided in sliding in that end of the cylinder that is attached to the casing, the other end of the cylindrical body comprising a head the diameter of which is greater than that of the cylindrical body and the diameter of the open end of the cylinder, so as to form a member whereby the pin is retained in the cylinder.

Thus, in the rest condition, the pin does nothing to disrupt the flow of gases through the turbine and does not therefore penalize engine performance.

If the onset of overspeed or breakage of the low-pressure turbine shaft is detected, the thrust from the explosion and from the gases released is exerted on the head of the pin and violently drives the pin in sliding through the open end of the cylinder until the head of the pin comes into abutment against the edge of the opening of the cylinder, thus retaining the pin in the cylinder.

Advantageously, the orifice of the casing is closed by a rupture disk made of a material able to withstand the operating temperatures of the turbomachine and able to be ruptured by the pin if the onset of overspeed is detected, the pin preferably having a spike able to pierce this rupture disk, this spike being formed at the opposite end of the cylindrical body to the head.

By virtue of this rupture disk, the pin is immobilized inside the cylinder in the rest position, and only the explosion and the release of gas resulting from a detection of the onset of overspeed or breakage of the low-pressure turbine shaft may, as a result of the violent thrust exerted on the pin, cause this pin to pierce the rupture disk in order to leave the cylinder. Furthermore, this rupture disk prevents the gases passing through the turbine from entering the cylinder containing the pin and the explosive capsule.

The cylinder advantageously comprises a lateral rim for attachment to the casing and means for electrically connecting the explosive charge to the means for detecting that the turbine is experiencing overspeed or that the shaft of this turbine has broken.

The present invention also relates to a turbomachine, such as an aircraft jet engine, equipped with an overspeed limitation device of the type described hereinabove.

BRIEF DESCRIPTION OF THE DRAWINGS

Other advantages and features of the invention will become apparent from reading the following description made by way of nonlimiting example and with reference to the attached drawings in which.

DESCRIPTION OF THE PREFERRED EMBODIMENT

Figure 1:
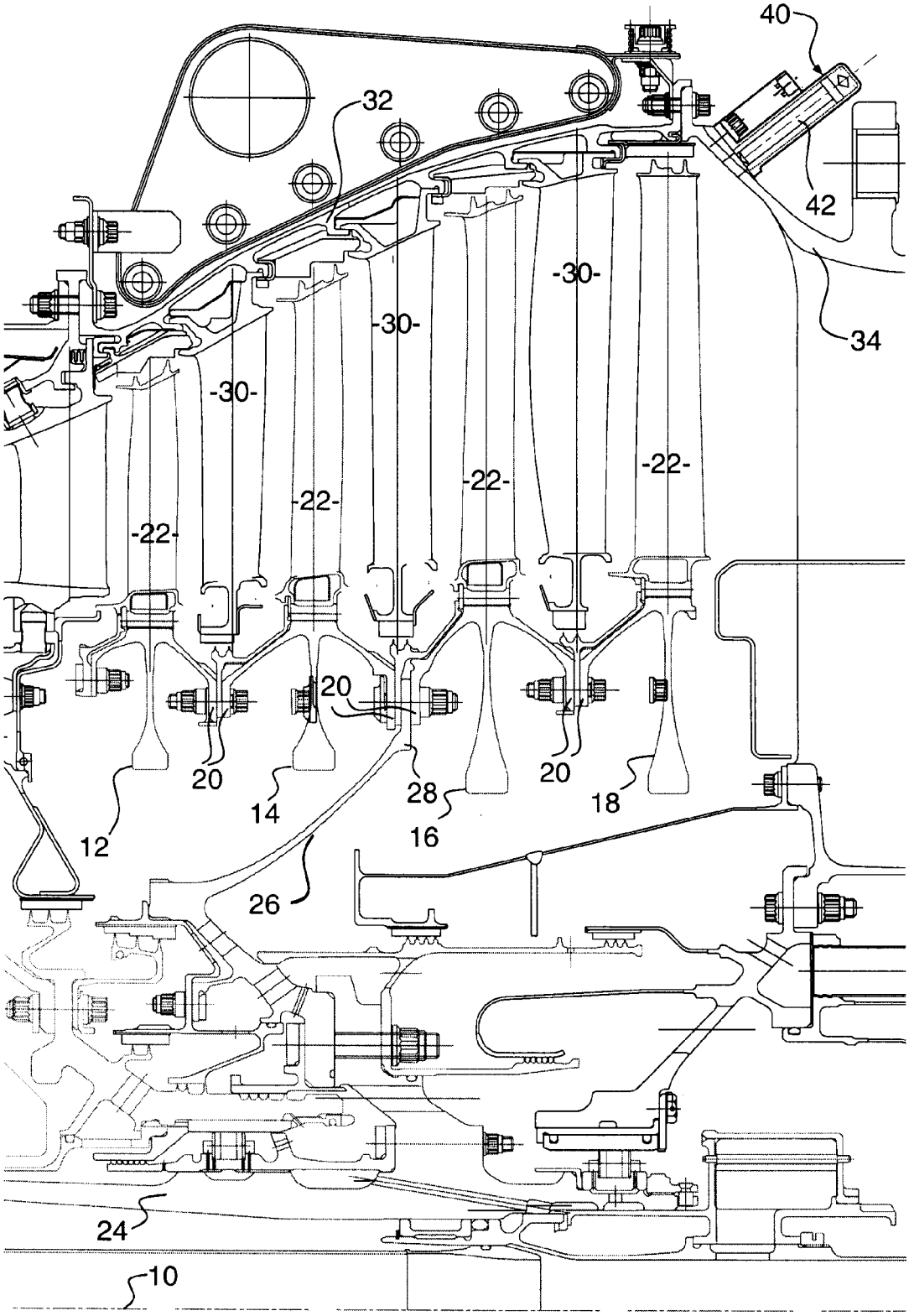
FIG. 1 is a partial schematic half view in axial section of a turbojet engine low-pressure turbine equipped with a device according to the invention.

Reference is made first of all to FIG. 1, which depicts a low-pressure turbine rotor comprising four disks 12, 14, 16, 18 assembled axially with one another by annular flanges 20 and bearing blades 22 which are mounted by blade roots at their radially internal end in slots in the exterior periphery of the disks 12, 14, 16, 18. The rotor is connected to the turbine shaft 24 by a drive taper 26 fixed by means of an annular flange 28 between the annular flanges 20 of the disks 14 and 16.

Between the blade stages 22 there are fixed vane stages 30 which are mounted by appropriate means at their radially outer ends on a casing 32 of the low-pressure turbine.

A turbine overspeed limiting device 40 according to the invention is mounted on the exterior surface of an exhaust casing 34 to which the turbine casing 32 is connected. The device 40 thus positioned is associated with the final stage of the turbine, but it is possible to use it for any turbine stage.

The turbine is also equipped with means for detecting that the rotor has begun to overspeed or that the shaft 24 of this turbine has broken, these means being depicted schematically as 36.

Figure 2:
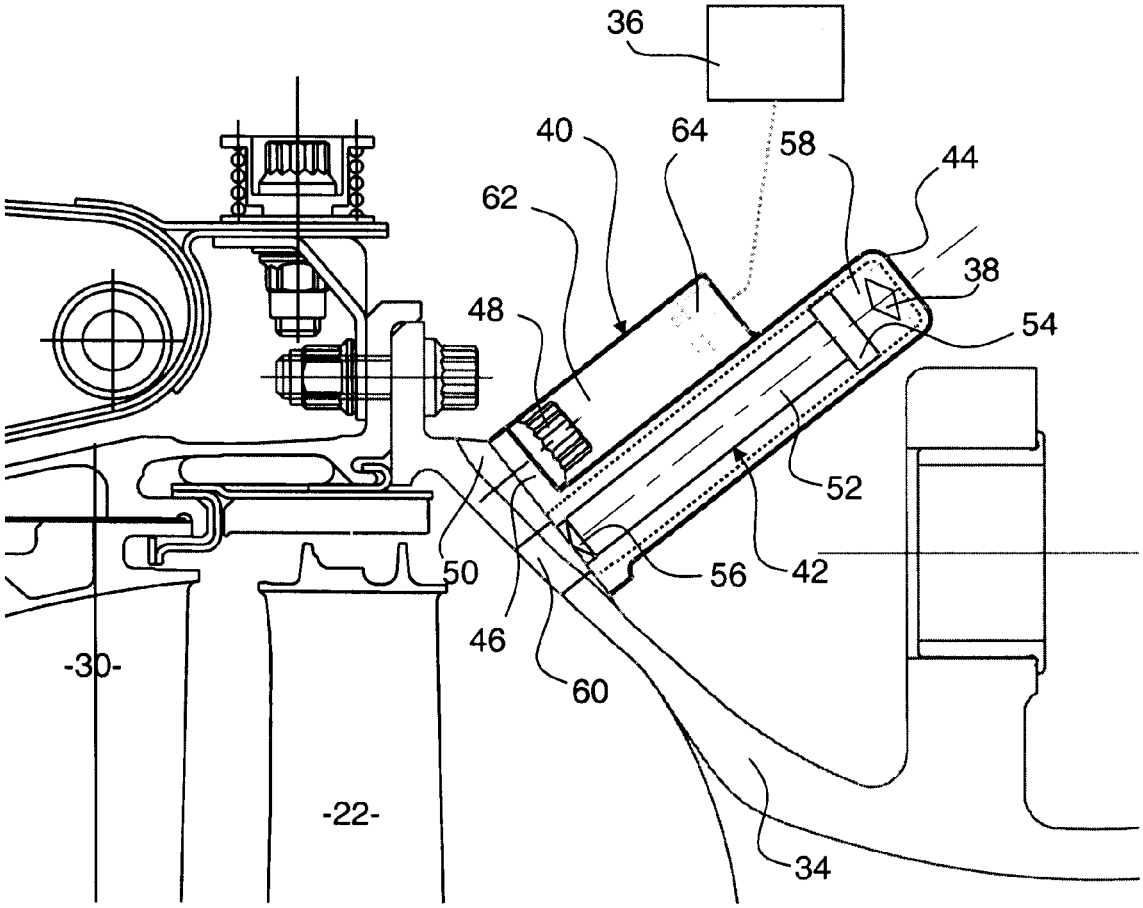
FIG. 2 is an enlarged schematic view of part of FIG. 1 illustrating the turbine overspeed limiting device according to the invention, in the rest position.

As can best be seen in FIG. 2, the overspeed limiting device 40 comprises a pin 42 made of a very hard metal housed in a cylinder 44, which, at its end pressed against the casing 34, has a lateral rim 46 fixed by one or more screws 48 to a mounting plate 50 formed on the exterior surface of the casing 34, the cylinder 44 being open at its end that is attached to the casing, and closed at its other end.

The pin 42 has a cylindrical body 52 comprising, respectively, at its two ends, a spike 56 and a head 54, the latter having a diameter greater than that of the cylindrical body 52 so as to form a member whereby the pin is retained in the cylinder. The head 54 is near the closed end of the cylinder 44 while the spike 56 faces its open end.

An explosive charge depicted schematically as 38 and possibly pellets of sodium azide or some other gas-generating substance, is/are positioned inside the cylinder, in the empty space 58 between the head 54 of the pin and the closed end of the cylinder.

The cylinder 44 is mounted in line with an orifice 60 of the casing 34 which opens onto the path of the blades 22 of the last stage of the rotor of the turbine. This orifice 60 has a diameter slightly greater than that of the cylindrical body 52 and smaller than that of the head 54.

In the rest position depicted in FIG. 2, the pin 42 is entirely housed in the cylinder 44, and the orifice 60 is closed off by a rupture disk made of a substance, such as a resin or a mastic, that is able to withstand the turbomachine operating temperatures and can be punctured by the spike 56 of the pin 42 under the effect of a strong thrust.

Electrical connection means 64 are mounted on the lateral support 62 connected to the cylinder 44 and to the lateral attachment rim 46 to allow the explosive charge to be controlled by the means 36 for detecting that the turbine is experiencing overspeed or that the shaft 24 of this turbine has broken.

The device described hereinabove works as follows:

When the onset of turbine rotor overspeed is detected, as a result of the breakage of the turbine shaft 24, or when breakage of the turbine shaft 24 is detected, the detection means 36 generate a signal applied to the connection means 64 to initiate the explosion of the explosive charge 38, causing a sudden release of nitrogen by the sodium azide pellets. The signal may also trigger the opening of a valve leading to a supply of pressurized gas from a storage reservoir or bled off the engine.

Figure 3:
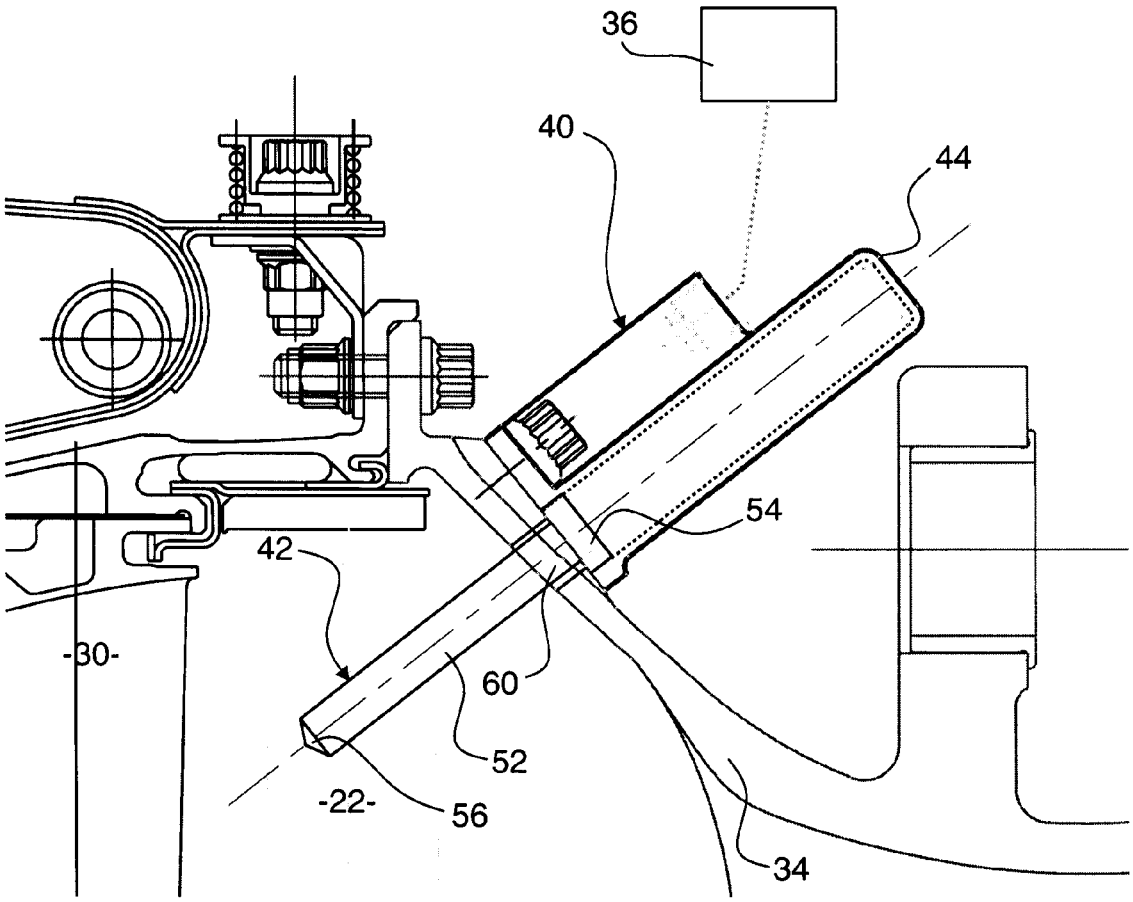
FIG. 3 is a view similar to FIG. 2 illustrating the turbine overspeed limiting device in the active position.

Under the effect of the strong thrust exerted by the gases on its head 54, the pin then pierces, via its spike 56, the rupture disk that closes off the orifice 60, and is propelled into the turbine through the orifice 60 until the head 54 butts against the edge of the orifice 60 as shown in FIG. 3.

Part of the pin 42 then lies in the path of the aforementioned blades 22, which means that these blades will smash against it.

Destroying the blades prevents any risk of the turbine rotor overspeeding.

The response time of the device according to the invention is very short: approximately 40 milliseconds (10 ms to detect the overspeed and 30 ms to explode the charge and propel the pin), whereas the response time of the devices known in the prior art is in excess of 100 ms.

The invention claimed is:

1. A device for limiting overspeed in a turbomachine in the event of breakage of the turbine shaft, comprising means for shearing the blades of at least one stage of the turbine, wherein these shearing means comprise means for propelling a pin into the path of the blades, these propelling means being mounted on a casing of the turbine or of the turbomachine and controlled by means that detect that the turbine is experiencing overspeed or that the shaft of this turbine has broken.

2. The device as claimed in claim 1, wherein the propelling means comprise a capsule of explosive substance housed in a cylinder that guides the pin.

3. The device as claimed in claim 2, wherein the cylinder also contains pellets of a gas-generating substance, such as sodium azide.

4. The device as claimed in claim 1, wherein the means for propelling the pin are connected to a source of pressurized gas.

5. The device as claimed in claim 2, wherein the cylinder is mounted on the outside of the casing in line with an orifice of this casing that opens onto the path of the blades, and comprises an open end via which it is attached to the casing, its other end being closed and containing the capsule of explosive substance.

6. The device as claimed in claim 5, wherein, in the rest condition before the onset of overspeed has been detected, the pin is entirely housed inside the cylinder and has a head positioned at the closed end of the cylinder and connected to a cylindrical body of a diameter smaller than that of the head, the opposite end of the body to the head being guided in sliding in that end of the cylinder that is attached to the casing.

7. The device as claimed in claim 6, wherein the head of the pin has a diameter greater than that of the open end of the cylinder and forms a member whereby the pin is retained in the cylinder.

8. The device as claimed in claim 5, wherein the orifice of the casing is closed by a rupture disk made of a material able to withstand the operating temperatures of the turbomachine and able to be ruptured by the pin if the onset of overspeed is detected.

9. The device as claimed in claim 5, wherein the pin has a spike formed at that end of its cylindrical body that faces the orifice in the casing.

10. The device as claimed in claim 5, wherein the cylinder comprises, at its open end, a lateral rim for attachment to the casing.

11. The device as claimed in claim 5, wherein the cylinder comprises a support for means for electrically connecting the explosive charge to the means for detecting that the turbine is experiencing overspeed or that the shaft of this turbine has broken.

12. A turbomachine, such as an aircraft jet engine, and which is equipped with an overspeed limitation device described in claim 1.

* * * * *